US008413786B2

(12) United States Patent
Roatis et al.

(10) Patent No.: US 8,413,786 B2
(45) Date of Patent: Apr. 9, 2013

(54) APPARATUS AND METHOD FOR REDUCING LOSS IN A VENDING MACHINE DUE TO FORCED ENTRY AND VANDALISM

(75) Inventors: Calin Vasile Roatis, Long Grove, IL (US); Richard Paeth, St. Charles, IL (US); Catalin Captarencu, Wheeling, IL (US); Gary L. Myers, Monee, IL (US)

(73) Assignee: TriTeq Lock and Security LLC, Elk Grove Village, IL (US)

( * ) Notice: Subject to any disclaimer, the term of this patent is extended or adjusted under 35 U.S.C. 154(b) by 1811 days.

(21) Appl. No.: 10/908,445

(22) Filed: May 12, 2005

(65) Prior Publication Data

US 2005/0274732 A1 Dec. 15, 2005

Related U.S. Application Data

(60) Provisional application No. 60/521,655, filed on Jun. 12, 2004.

(51) Int. Cl.
*A47F 1/04* (2006.01)
*G07F 9/10* (2006.01)

(52) U.S. Cl.
USPC ..... 194/350; 221/154

(58) Field of Classification Search ..... 194/350; 221/154
See application file for complete search history.

(56) References Cited

U.S. PATENT DOCUMENTS

| | | | | |
|---|---|---|---|---|
| 3,089,330 | A | 5/1963 | Kerr | |
| 3,550,412 | A | 12/1970 | Pitel et al. | |
| 3,680,937 | A * | 8/1972 | Steeley | 312/321.5 |
| 3,867,801 | A * | 2/1975 | Hoefling | 52/455 |
| 4,167,104 | A | 9/1979 | Bond | |
| 4,326,620 | A | 4/1982 | Felix et al. | |
| 4,355,830 | A | 10/1982 | Rau, III | |
| 4,406,358 | A * | 9/1983 | Zahradnik | 194/350 |
| 4,552,001 | A | 11/1985 | Roop | |
| 4,718,547 | A | 1/1988 | MacTavish | |
| 4,923,090 | A * | 5/1990 | Rockola et al. | 221/312 R |
| 4,973,109 | A * | 11/1990 | Diedrich | 312/114 |
| 5,076,078 | A * | 12/1991 | Weger, Jr. | 70/54 |
| 5,081,568 | A | 1/1992 | Dong et al. | |
| 5,096,088 | A * | 3/1992 | Grossi | 221/12 |
| 5,117,538 | A | 6/1992 | Henry | |
| 5,232,077 | A * | 8/1993 | Nichols | 194/206 |
| 5,390,515 | A | 2/1995 | Essick | |
| 5,601,177 | A | 2/1997 | Oden | |
| 6,082,519 | A | 7/2000 | Martin et al. | |
| 6,125,989 | A | 10/2000 | Oden | |
| 6,230,426 | B1 | 5/2001 | Fakhoury et al. | |
| 6,571,931 | B2 | 6/2003 | Oden | |
| 6,575,504 | B2 | 6/2003 | Roatis et al. | |
| D477,983 | S | 8/2003 | Burdett et al. | |
| D487,777 | S | 3/2004 | Roatis et al. | |
| 6,742,366 | B1 * | 6/2004 | Lai | 70/58 |
| 6,962,285 | B2 * | 11/2005 | Douglass et al. | 235/379 |

* cited by examiner

*Primary Examiner* — Mark Beauchaine

(74) *Attorney, Agent, or Firm* — Factor Intellectual Property Group, Ltd

(57) ABSTRACT

An apparatus and method is disclosed for use with a vending machine having a cabinet for containing product to be dispensed, and a door for closing the cabinet. The door has a vertical column with two sides and a front face, the front face having openings that permit customer interface devices to be accessed by a customer. A continuous integral panel is secured to the vertical column and extends across a width of the front face and side of the vertical column.

56 Claims, 10 Drawing Sheets

APPARATUS AND METHOD FOR REDUCING LOSS IN A VENDING MACHINE DUE TO FORCED ENTRY AND VANDALISM

RELATED APPLICATIONS

This application claims the benefit of U.S. Provisional Patent Application Ser. No. 60/521,655, filed Jun. 12, 2004, and herein incorporated by reference. This application is also related to U.S. Pat. No. D487,777, issued Mar. 23, 2004, herein incorporated by reference.

FIELD OF THE INVENTION

The present invention relates to the improved construction of a vending machine and, in particular, to devices for reducing loss due to theft and vandalism to such vending machines.

FEDERALLY SPONSORED RESEARCH OR DEVELOPMENT

None

BACKGROUND OF THE INVENTION

The vending industry has been besieged with an ongoing issue of vandalism and break-ins. Vandalism and break-ins result in the loss of currency stored in the machines, costs for fixing the machines, and sales losses while the machines are inoperable due to damage.

One common style of vending machine in use over the years generally includes an outer door that has a steel vertical "column" on the non-hinged side of the cabinet door that houses the money, vending machine logic systems, a locking system, a user interface, and, a paper currency validator. The user interface may include, and often does include, vend select buttons, a display, a coin entry, a coin eject button and a coin return cavity. Additionally, the outer door of these machines typically incorporates a large panel beside the vertical column that is used for advertising. This type of machine configuration may be referred to herein as a side-column machine referring to the position of the vertical column on the outer door.

More recently, machines have been developed for vending soft drinks where the vertical column is located at a mid point between the hinged and opening sides of the outer door. Such a vending machine is manufactured and sold by The Vendo Company, Fresno, Calif., under the model designation Pepsi High Visibility Vendor ("HVV"). This type of machine may be referred to herein as a center-column machine, referring to the relative location of the column in the outer door. As with the earlier vending machine types this center vertical column includes one or more customer interface access points such as a coin entry, an eject actuator, a card reader, a coin return cavity, and a paper currency validator. However, unlike prior vending machines, the vend-select actuators on the HVV-style machine are located to the left and right of the vertical column.

As used herein, the vending machine front is considered to be the area where the user interfaces are located.

There are many security devices in the marketplace today that have incrementally improved security of specific areas of the vending column. These devices are designed to thwart attempts to gain access to the vending machines through external attacks. An external attack is being defined as a method using any other device other than what was intended to gain access to the inside of the vending machine. Examples of this type of attack are: prying the door with a crowbar, drilling or sawing through door lock and latch components, hammering in vulnerable panels and attached equipment such as the paper currency validator and the product select buttons of the vending machine. These attacks are typically focused on the column area of the vending machine because the money and the locking system are housed inside the column.

The current security devices available on the market are typically focused on preventing specific attacks or attacks on a specific area or device on the machine. For instance, there are devices designed to locally cover and fortify the coin entry area. There are also devices that cover and fortify the paper currency validator. These devices however, leave other areas of the vertical column still vulnerable. Combining separate select devices for fortifying more than one area poses the problem of leaving non-integrated seams between fortification devices which can become a point of attack and present an unsightly hodge-podge of connectors and connections. Another problem is that disparate fortification devices may not even fit together, with one device accommodating desired points of attachment to the exclusion of another device, for example.

There are also devices that provide a secondary external lock such as a padlock and the like to the outer door. Often these devices are of a design that, which may be practical to add to vending machines which are placed outside, they often do not allow for attachment to vending machines that are placed indoors, such as within a hotel. For example, one common design consists of a lock mounted to the side of the vending machine. In particular, the lock consists of a padlock or the like that is attached to a pair of brackets wherein one bracket is attached to the side of the vending machine cabinet and the other bracket is attached to the outer door. Due to the space required to access this secondary lock, this design can be unsuitable where it is desired to bank vending machines side-by-side, or place the side of the vending machine against a wall.

Another prior art design consists of a lock mounted proximate to the bottom front of the vending machine. In particular, the lock consists of a pair of arms wherein one arm is attached to, and extends from, the bottom of the vending machine outer door toward the consumer or front side of the door. The other arm is attached to the bottom of the vending machine cabinet and extends past the door of the vending machine when the door is closed. The arms are secured together with a padlock or the like that can be attached to the portions of the arms extending from the bottom front of the vending machine. As expected, mounting a lock near the floor can result in the lock being susceptible to fouling by contaminants such as dirt, and people tripping on it. In addition, the protrusion of the arms into the consumer space can result in unpleasant contact with the ankles of customers and persons servicing the machine. The proximity of such a device to the ground also causes a noticeable inconvenience to those servicing the machines which may cause them to leave the padlock off of the machine between service sessions, rendering the device useless.

The unique invention disclosed herein provides an integrated solution for many types of common external vending machine vandalism attacks, while providing added security benefits and structural enhancements to the integrity and overall operation of the vending machine door.

SUMMARY OF THE INVENTION

The present invention is directed to security devices that can be integrated as part of the original equipment manufacture (OEM) of the vending machine or can be employed as an after-market enhancement to a vending machine. These OEM or after-market devices or vending machines, include a cabinet for containing product to be dispensed, along with a door for closing the cabinet. The door has a vertical column with two sides and a front face. The front face has openings which permit customer interface devices contained in the column of the vending machine, to be accessed by a consumer.

According to one aspect of the invention, a continuous integral panel is secured to the front of the vertical column. The panel extends across at least a majority of a width of the front face of the vertical column and for side-column machines the panel may extend along at least a majority of a horizontal width of a side of the vertical column.

According to another aspect of the invention, the panel is provided with openings which align with at least one customer interface opening in the vertical column. These openings permit at least one customer interface device to be accessed by a customer through the panel. Such customer interface devices may include: a coin entry; an information display; an eject actuator; a paper currency validator; a card reader; and in side-column machines, product/vend selection actuators; and, a coin return cavity.

According to another aspect of the invention, the vertical column of a side-column machine has an access opening for a T-handle, and the continuous panel provides an opening for access to the T-handle.

According to another aspect of the invention applied to a side-column machine, the continuous panel extends beyond a rear edge of the side of the column and overlaps a portion of the side of the vending machine cabinet.

According to another aspect of the invention applied to a side-column machine, a vertical channel is formed in a strip mounted to a side of the cabinet, and the continuous panel extends into the channel.

According to another aspect of the invention, the continuous panel has a top end and a bottom end. At the top end, a cross member spans between a top edge of the front face and a top edge of the portion of the panel extending along a side of the vertical column.

According to another aspect of the invention, the cross member incorporates a first member of a locking device attached to the door or a panel, and a second, mating, member of the locking device attached to the cabinet. Accordingly, the door can be further secured to the housing through cooperation of the first and second members.

According to another aspect of the invention, the cross member is made to present an open edge which deflects forces applied by a prying tool when the tool is inserted between the open edge and edges of the door or cabinet when closed together. In a specific preferred embodiment, the open edge forms one leg of a triangle.

According to another aspect of the invention, a simple panel portion can be secured to one or more of the front face or a side of the vertical column, or to a side face of the cabinet. This panel has a top extending generally horizontally over a junction of edges presented where the door and cabinet form a seal when closed. In this aspect of the invention, an open edge can also be provided to deflect prying tools. An auxiliary locking device can also be used with this aspect of the invention wherein the top of the panel portion incorporates a first member of a locking device, and the cabinet has attached thereto a second, mating member of the locking device.

According to another aspect of the invention, a continuous integral panel is secured to the vending machine door over at least a portion of the front face of the vertical column. The panel is provided with openings which align with at least two customer interface openings in the vertical column. Again, the customer interface devices may be: a coin entry with an instructional display and an eject actuator; a paper currency validator; a card reader; product/vend selection actuators; a coin return cavity; or typically a combination of these. Also, for example in side-column machines, the continuous panel may extend over a T-handle area and accordingly an opening in the panel can be provided to accommodate access and operation of a T-handle. In this embodiment, the invention can also be modified so that the continuous panel extends over at least a portion of the side of the vertical column.

According to another aspect of the invention, the continuous panel, whether deployed only on the front face of the vertical column or both a front face and a side of the column when applied to a side-column machine, extends over approximately 50 percent of the vertical dimension of the vertical column.

According to another aspect of the invention, the continuous panel includes a shield for a paper currency validator. The shield includes a front wall which is spaced sufficiently from the vertical column such that an impact on the front wall of the shield is not transferred directly to the face of the paper currency validator or to the vertical column by direct contact with the front wall of the shield. At least one support for supporting the front wall of the shield and spacing it from the paper currency validator is provided. An opening in the front wall of the shield is provided to permit passage of a bill through the opening and into an opening in the paper currency validator.

According to yet another aspect of this invention that is particularly useful in after market applications, the opening in the front wall of the shield is adjustable in size and vertical location. Another aspect of this invention provides that the shield front face and support define a cavity surrounding the paper currency validator and the cavity is sized to accommodate more than one vertical or horizontal positioning of the paper currency validator in the vertical column.

Other embodiments, systems, methods, features, and advantages of the present invention will be, or will become, apparent to one having ordinary skill in the art upon examination of the following drawings and detailed description. It is intended that all such additional systems, methods, features, and advantages included within this description be within the scope of the present invention, and be protected by the accompanying claims.

DESCRIPTION OF THE DRAWINGS

The invention may be better understood with reference to the following drawings. The components in the drawings are not necessarily to scale, emphasis instead being placed upon illustrating the principles of the invention. In the drawings, like reference numerals designate corresponding parts throughout the several views.

DESCRIPTION OF DETAILED EMBODIMENTS

The following descriptions of detailed embodiments are for exemplifying the principles and advantages of the inventions claimed herein. They are not to be taken in any way as limitations on the scope of the inventions.

Figure 1:
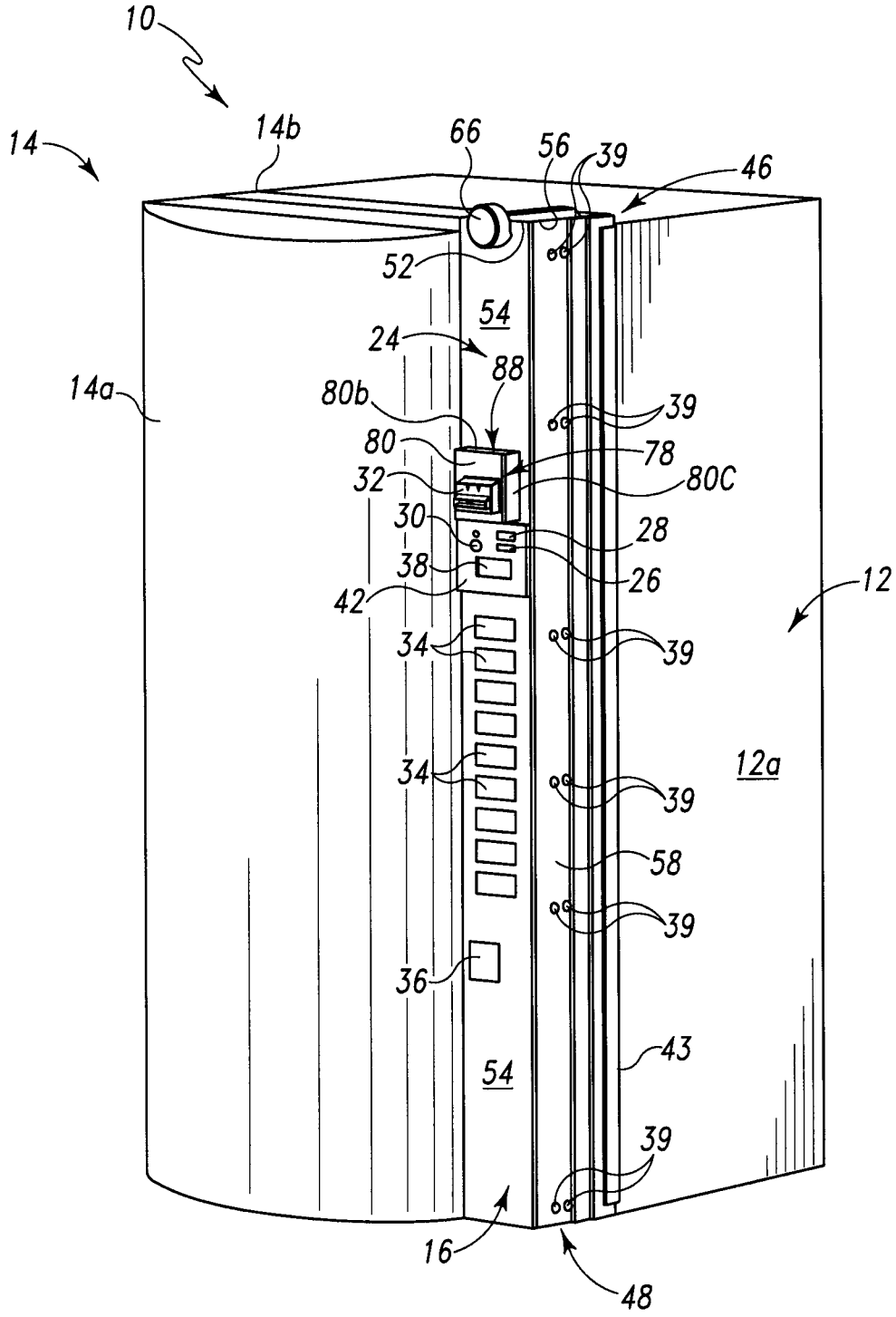
FIG. 1 is a perspective view of a side-column vending machine having a device or panel attached thereto in accordance with the present invention.

FIG. 1 discloses a side-column type vending machine 10 having a cabinet 12 for containing product(s) to be dispensed, in this case cold drinks. A conventional door assembly 14, comprising an outer door 14*a* and an inner door 14*b* is provided. The outer door 14*a* provides for closing the cabinet 12 wherein the inner door 14*b* is sandwiched between the outer door 14*a* and the cabinet 12. The inner door 14*b* provides thermal insulation for aiding in maintaining a stable temperature for the goods within the vending machine 10. Accordingly, conventional gaskets or seals 15*a*, 15*b* (FIGS. 3 and 4) can be mounted about both sides of the outer periphery of the inner door 14*b*. Making up the non-hinged side of the outer door 14*a* is a vertical column 16 (see also FIGS. 3, 4, and 14) in which consumer access and interface devices are housed.

Figure 3:
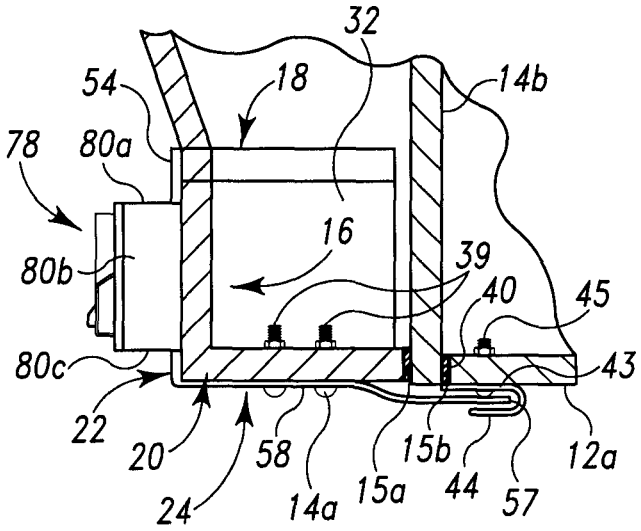
FIG. 3 is a partial view in cross section of an alternative embodiment of the panel of FIG. 1, if taken along line A-A of FIG. 2.
Figure 4:
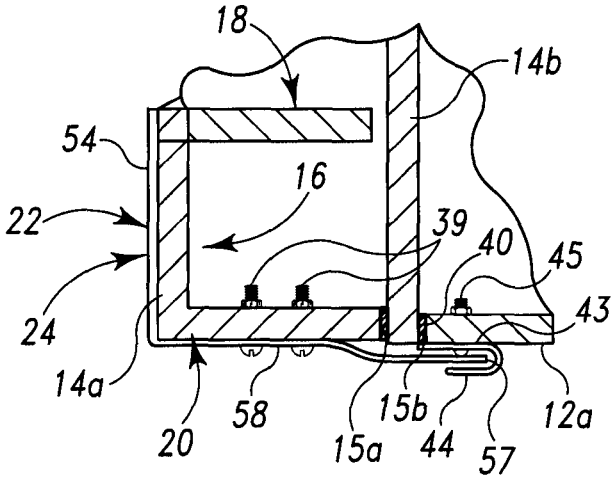
FIG. 4 is a partial view in cross section of an alternative embodiment of the panel of FIG. 1, if taken along line B-B of FIG. 2.
Figure 14:
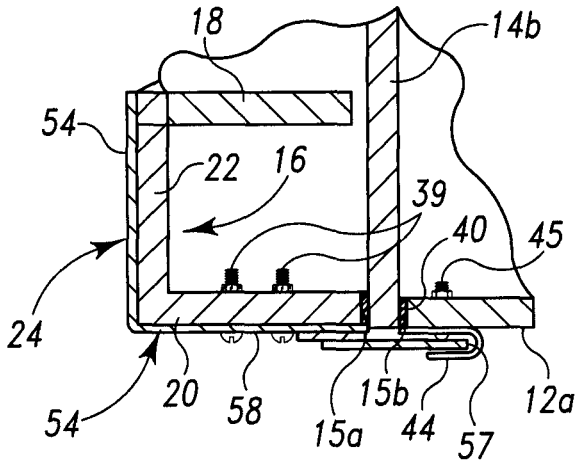
FIG. 14 is a partial view in cross section taken along line B-B of FIG. 2.

FIGS. 3, 4, and 14 disclose that the vertical column 16 has two sides 18 and 20, and a front face 22. The front face 22 has openings for permitting customer interface devices to be accessed by a consumer.

FIG. 1 discloses a continuous integral panel 24 in accordance with the present invention. The panel 24 is generally L-shaped with a front face or surface 54 and a generally perpendicular side face or surface 58. The panel 24 is made of a metal or metal alloy and is secured to the vertical column 16 of the vending machine 10. The panel 24 provides openings which align with at least two customer interface openings in the vertical column 16 (FIGS. 3, 4, and 14), so as to permit customer interface devices to be accessed by a customer through the panel 24. The vending machine 10 can include, but is not limited to, the following customer access and interface devices: a coin entry 26 with a display 28 and an eject actuator 30; a paper currency validator 32; product/vend selection actuators 34; and a coin return cavity 36. The vertical column 16 (FIGS. 3, 4, and 14) also houses, and has an access opening for, a T-handle 38 for latching and locking the outer door 14*a* to prevent access to the vending machine 10. The panel 24 likewise provides an opening for the T-handle 38 for access and operation by service personnel.

FIGS. 3, 4, and 14 disclose that the L-shape of the continuous panel 24 extends beyond a rear edge 40 of the side 20 of the vending machine column 16 and overlaps a portion of the side 12*a* of the cabinet 12. Thus, when the outer door 14*a* is closed, the abutting portions of the doors 14*a*, 14*b* and cabinet 12 are at least partially covered by the panel 24.

A vertical strip 43 having a J-shaped channel 44 is attached to the side 12*a* of the cabinet 12, albeit, in an alternative embodiment, the strip could be omitted and the channel could be formed integrally in the side of the cabinet. As can be seen, the panel 24 in this embodiment extends into the channel 44 to form another access barrier to frustrate leverage for prying tools. In one embodiment, the vertical strip 43 is made of a metal or metal alloy.

Figure 2:
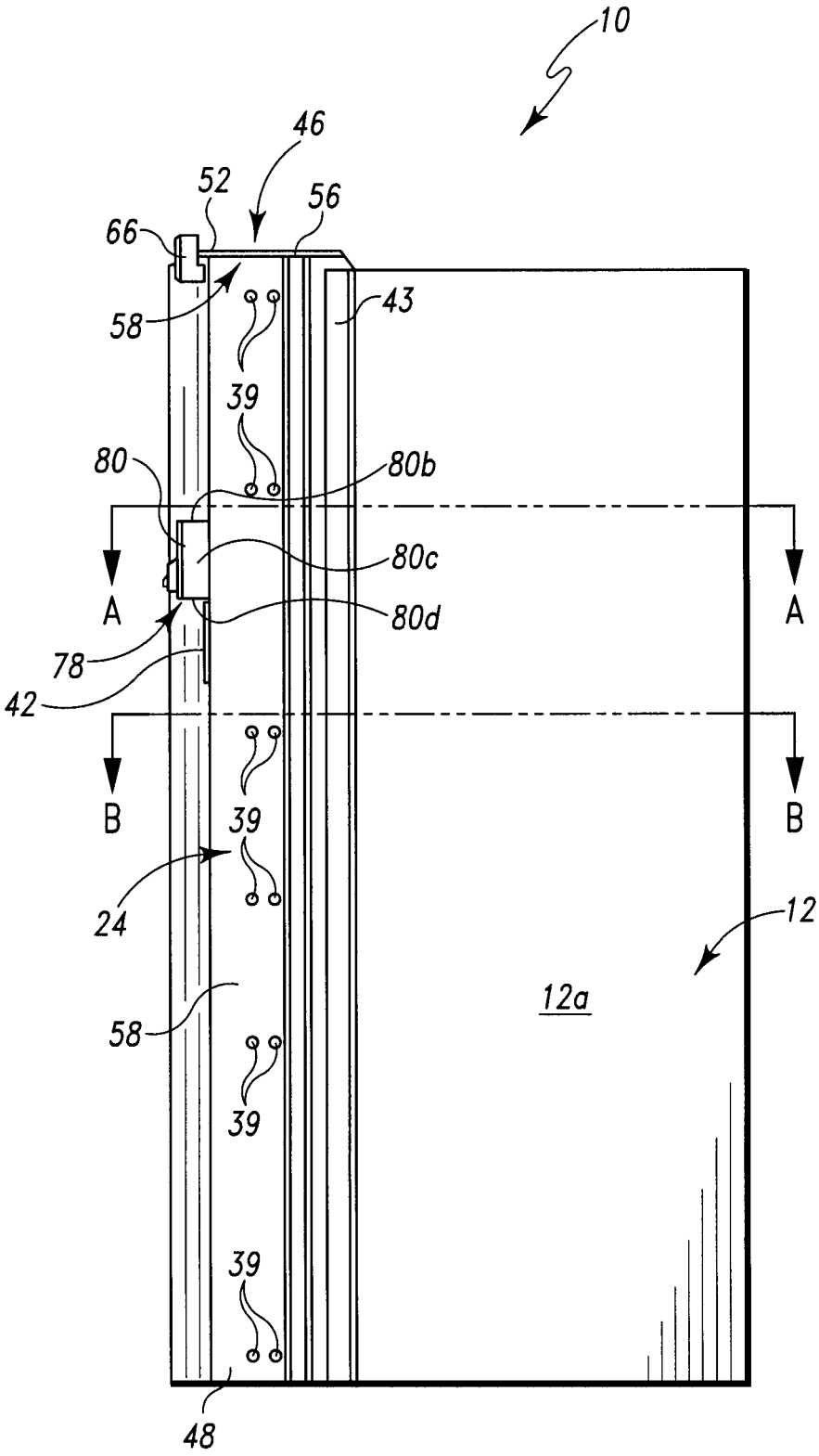
FIG. 2 is a side view of the vending machine of FIG. 1.
Figure 5:
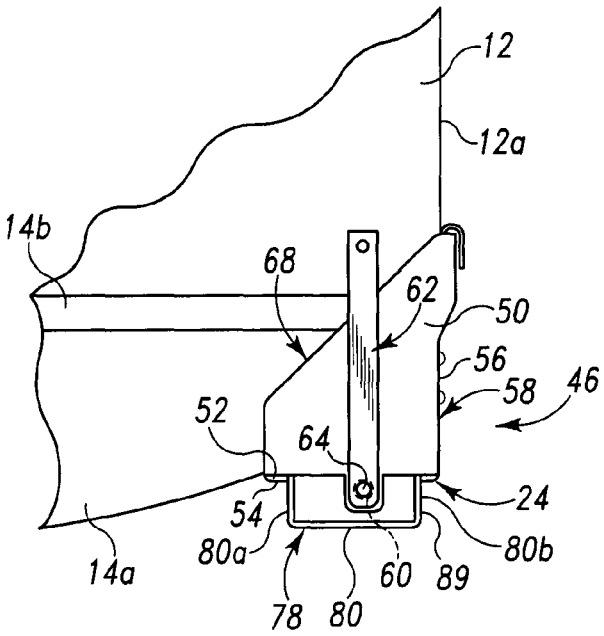
FIG. 5 is a partial top view of the vending machine of FIG. 1 showing the non-hinged side of the front of the machine.

FIGS. 1 and 2 disclose that the continuous panel 24 has a top end 46 and a bottom end 48. Turning to FIG. 5, at the top end 46, a cross member 50 spans between or proximate to a top edge 52 of the front face 54 of the panel 24 and the top edge 56 of the portion or side 58 of the panel 24 extending along the side 20 of the vending machine vertical column 16 (FIGS. 3, 4, and 14). In one embodiment, the cross member 50 can be a plate that is attached, by welding or the like, or integral to both of the top edges 52 and 56 of the panel 24.

Figure 6:
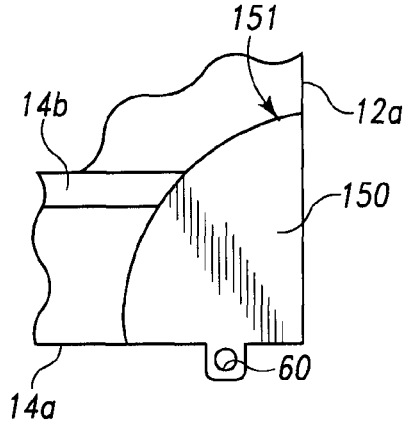
FIG. 6 is a schematic view of a top front corner of the vending machine of FIG. 1 with an alternate embodiment of the device or panel attached thereto.

FIG. 6 discloses an alternate design of cross member (150), turning to both FIGS. 5 and 6, the cross members 50 and 150 incorporate a first member of a locking device or structure, which in this case is a tab having an opening 60. As disclosed in FIG. 5, a metal strap 62 is a second mating member of the locking device which also includes an opening 64. Such a strap is intended to be used with member 150 although not shown in FIG. 6.

The cross members 50, 150 and the metal strap 62 can be secured together by inserting in the openings 60 and 64 any fastener 66 such as a padlock, a shackles padlock, a lock member, or the like as shown in FIGS. 1 and 2. Many other locking device structures or arrangements will come to mind in view of this disclosure. However, one key point is that the cross member 50 provides a platform for mounting a lock which permits easy access to such a device and a point of locking at the top front end of the outer door 14*a* where it is not readily vulnerable or in the way of consumers or other vending machines.

As best shown in FIG. 5, the cross member 50 presents an open edge 68 which deflects forces applied by or to a prying tool when such a tool is inserted between the open edge 68 and edges (see e.g. FIGS. 3, 4, and 14, reference number 40) of the outer door 14*a* and inner door 14*b*. In this case, the open edge 68 forms one leg of a triangle which is not perpendicular to or in parallel with edges of the door assembly 14 where a prying tool can be used. Other surfaces or open edge shapes could provide advantages according to the invention, for example, as disclosed in FIG. 6, the alternate cross member 150 has a curved outer surface 151.

Figure 15:
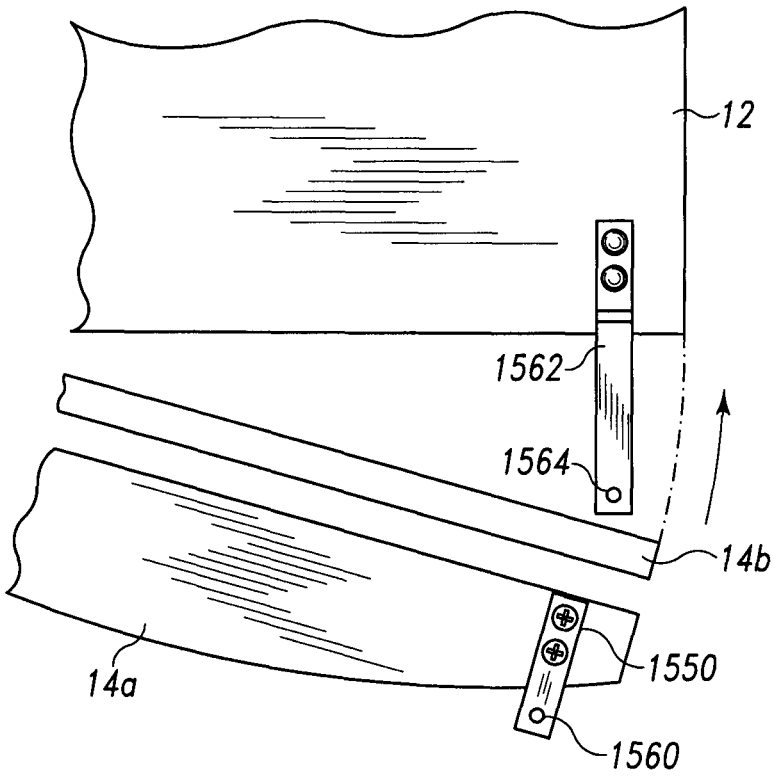
FIG. 15 is a plan view of a top front corner of a vending machine with an alternative embodiment of a locking device attached thereto.
Figure 16:
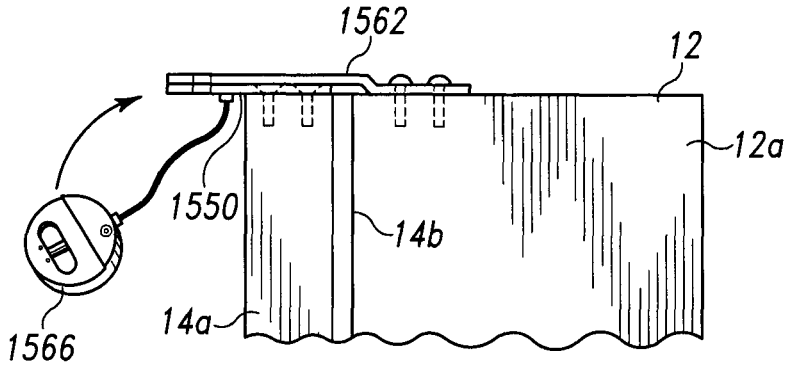
FIG. 16 is a side elevation view of the locking device of FIG. 15.

In an alternative embodiment shown in FIGS. 15 and 16, the locking device can include a metal member or strap 1562 having a proximal end and a distal end. The proximal end is secured to the top of the vending machine cabinet 12 with bolts, rivets, weldments or the like. The distal end has an opening 1564 and overhangs the outer door 14*a* to the vending machine when the outer door 14*a* is closed. The portion of the metal strap 1562 between the proximal end and the distal end can be bent such that the proximal end and distal end are in spaced parallel relationship to each other when viewed from the side as shown in FIG. 16.

The locking device also includes a second metal member or strap 1550 having a proximal end and a distal end. The proximal end is secured to the top of the vending machine outer door 14*a* with bolts, rivets, weldments or the like. The distal end has an opening 1560 and extends beyond the front of the outer door 14*a*. As disclosed in FIG. 16, when the outer door 14*a* is closed, the openings 1564 and 1560 to the members 1562 and 1550, respectively, are in alignment with each other. Accordingly, the members 1564 and 1562, and thus the vending machine outer door and cabinet, can be secured together by placing an object though the openings 1564 and 1560 such as a shackle of a lock 1566. In an embodiment, the lock 1566 can be tethered to the vending machine by a cable with one end of the cable attached to the lock and the other end attached by conventional means to the vending machine or one of the locking members 1562 or 1550.

Figure 7:
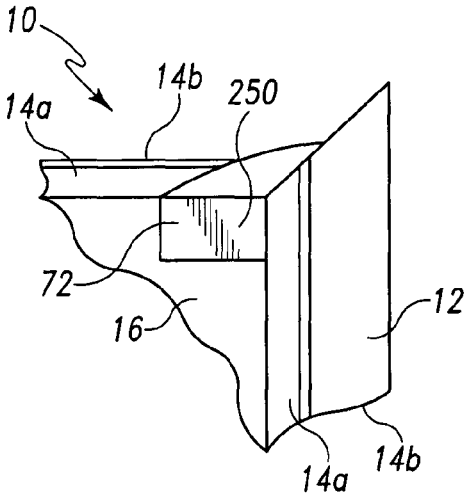
FIG. 7 is a partial perspective view of a top front side of the vending machine of FIG. 1 with an alternative embodiment of the device or panel attached thereto.
Figure 8:
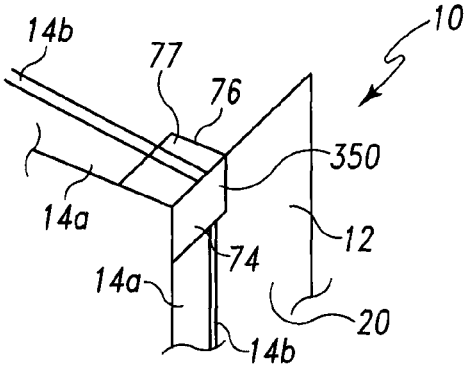
FIG. 8 is a partial perspective view of a top front side of the vending machine of FIG. 1 with yet another alternative embodiment of device or panel attached thereto.
Figure 9:
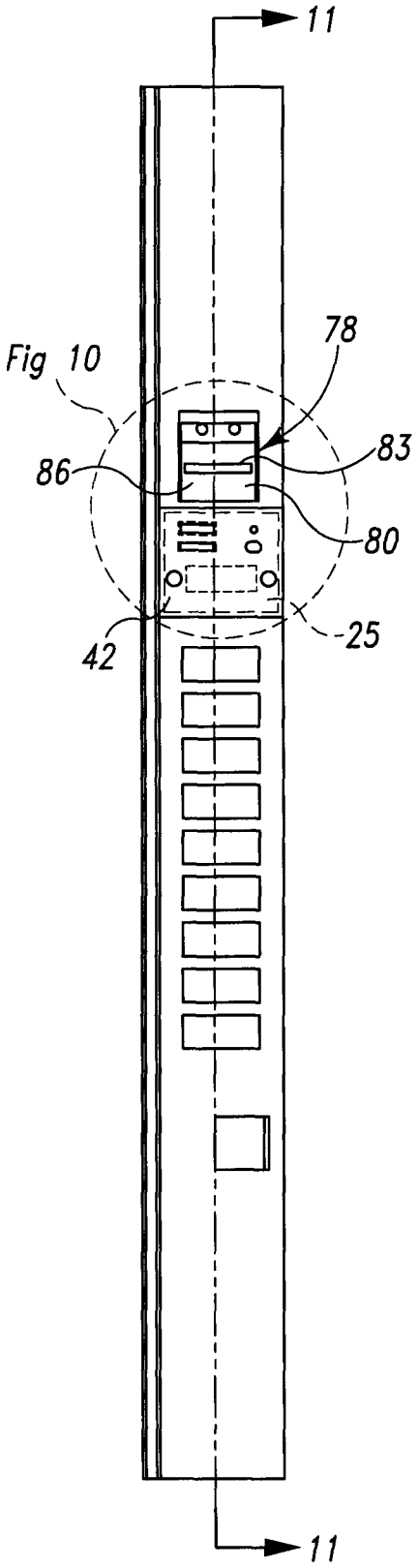
FIG. 9 is a partial view of the front of the vending machine of FIG. 1.
Figure 10:
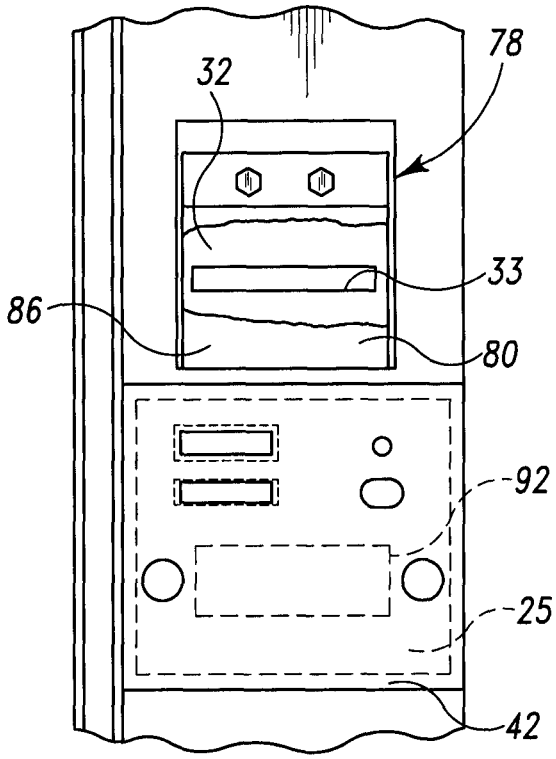
FIG. 10 is an enlarged partial view of the front of the vending machine contained within the circled portion of FIG. 9 and, wherein the portion about the opening to the paper currency validator is shown in fragmentary.
Figure 11:
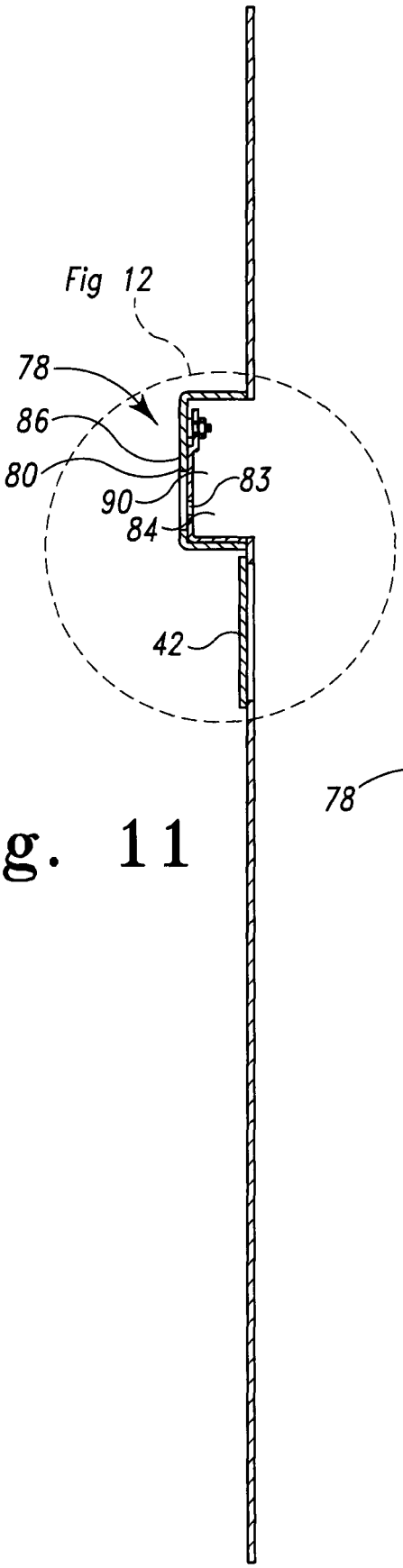
FIG. 11 is a schematic view in cross section taken along line 11-11 of FIG. 9.
Figure 13:
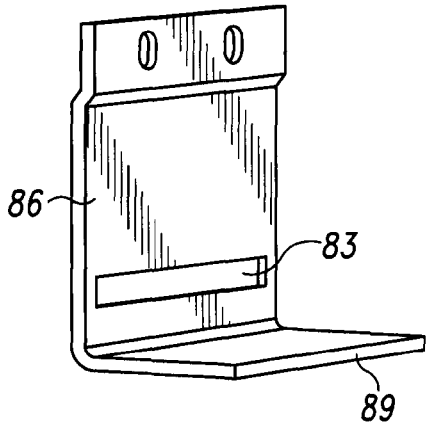
FIG. 13 is a perspective view of an adjuster/blocker for the shield of the device or panel of FIGS. 9-12.
Figure 12:
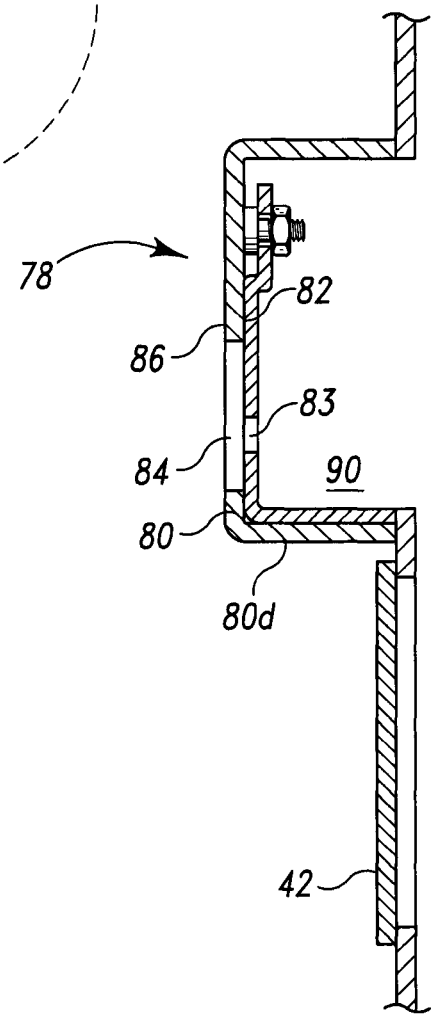
FIG. 12 is partial expanded view of a shield contained within the circled portion of FIG. 11.

As disclosed in FIGS. 7 and 8, it is contemplated that the advantages of the cross member could also be obtained with structure either tied to a panel such as panel 24 or by a smaller simpler arrangement such as the panels 72 (FIG. 7) and 74 (FIG. 8) shown mounted to vending machine 10 in alternate embodiments.

For example, FIG. 7 discloses a cross member 250 that does not truly cross between top portions of an L-shaped vertical panel such as panel 24. Instead, the cross member 250 is attached by portion 72 which is attached to the front of the vertical column 16 by rivets, bolts, or the like.

FIG. 8 discloses a similar mounting but attachment of the cross member 350 is to the side 20 of column 16. In such an embodiment, the cross member 350 has two open edges 76 and 77 that deflect prying tools. It is also contemplated that in other embodiments the devices such as cross members 250 (FIG. 7) and 350 (FIG. 8) could be mounted to the side 12*a* of the cabinet, or to the front face 22 and the side 20 of the vertical column 16.

As will be appreciated by those having ordinary skill in the art, the cross member as disclosed in FIGS. 5-8 also provides a water-shed function over the non-hinged upper corner of a vending machine door seals 15*a*, 15*b*.

FIGS. 1, 2, 3, 5, and 9-13 disclose that the panel 24 has a shield 78 for protecting paper currency validator 32. Makers of such paper currency validators include, but are not limited to, MARS, COINCO, CONLUX, and others. The paper currency validator 32 has an opening or slot for accepting paper currency and is aligned with an opening in vertical column 16 for passage of paper currency into the paper currency validator. As will be appreciated by those having ordinary skill in the art, the shield 78 can be mounted to the vertical column either by itself or as part of a continuous panel (i.e., panel 24) which can extend around to the side 20 of the column 16 or, alternatively, extend vertically to cover one or more other access devices. The latter case is shown in FIGS. 1-3, 5 and 9-13.

The shield 78 includes a front wall 80 which is spaced sufficiently from the vertical column front face 22 whereby impact forces acting on the wall 80 are not transferred to the paper currency validator 32 or the vertical column 16 by a direct contact with the front wall 80 of the shield 78. While such spacing may be accomplished in other ways and geometries (for example a round front wall and a tubular support) the figures (e.g., FIGS. 2 and 3) disclose that a support, in the form of side walls 80*a*-80*d*, space the front wall 80 from the paper currency validator 32 and tend to transfer force to the panel 24 along a rectangle formed by the support walls 80*a*-80*d*. This is advantageous as the footprint defined by the wall supports 80*a*-80*d* can be strategically made large enough to prevent force being applied near the mounting fasteners of the paper currency validator 32 in the vertical column 16.

FIGS. 9 and 11-13 also disclose shield 78 as having an opening 83 exposed in the front wall 80 of the shield for permitting passage of a bill therethrough and into the paper currency validator 32 (FIGS. 3 and 10-13).

Particularly useful for aftermarket use of the shield 78 is the fact that the opening or slot 83 may be configured to be adjustable in vertical alignment. This is provided by the shield 78 having a relatively larger opening 84 in the front wall 80. The size of the opening 84 is designed to accommodate multiple vending machine designs where the paper currency validator (such as validator 32) or its slot is mounted at differing vertical locations. To customize a particular shield 78 to a given machine, a plate 86 is located within the shield 78 that can be adjusted up or down by to provide an opening 83 at a vertical location corresponding to an opening 33 in paper currency validator 32 (See FIG. 10). Once the opening 83 is in the correct position, the plate 86 is secured from the inside of the shield 78 using bolts coupled to welded studs. Accordingly, access by vandals is reduced to the size of the opening 83, versus the generic opening size of opening 84.

It should be appreciated that the front wall 80 of the shield 78 and the support side walls 80*a*-80*d* define a five-sided enclosure having an internal cavity 90. As previously indicated, the cavity 90 can be sized so that it accommodates a variety of known vending machine designs and the relative differences in size of, or vertical and horizontal positioning of, the paper currency validator 32 in the vertical column 16. The insert 86 is designed as to allow passage only of paper currency (e.g., dollar bill) and prevent crowbars, hammers and the like from accessing the paper currency validator 32. Accordingly, this protects the paper currency validator 32 from direct attacks via the entry slot and also inhibits impact forces that can dislodge the paper currency validator 32 from its internal mounting mechanisms within the vending machine. Therefore, the addition of the box substantially improves security of this area of the vending machine.

In a preferred embodiment of the invention for side-column machines, the panel 24 consists of what can be called a corner or L shape that covers the column area of the vending machine 10. Preferably, the panel 24 aligns with the manufacturer's original holes, placement of the coin entry area 26, vend select button placement 34, "dollar" bill or paper currency validator placement 32, coin return cavity 36, coin return or eject button 30, display area and alternatively the T-handle opening 38.

The panel 24 is preferably made of steel and when applied to the existing corner will effectively laminate at least a portion of the exposed surfaces of the vending machine. In one embodiment, the shield 78, the cross member 50, and the area 92 about the coin entry 26 and eject actuator 30 consists of panels that are welded together. One aspect of the invention is that the welds are of a continuous type resistive welding which results in areas that make dislodging by the use of prying extremely difficult. The difficulty can be generally quantified as a time interval expressed as a percent of the base time it would take to overcome the original column device design and gain unauthorized access to the machine. As a whole, it is believed that the present invention would extend the time by a factor of three at minimum.

As shown in FIGS. 3 and 4, the side 58 of the panel 24 can be shaped (e.g., bend, angled, or the like) such that the outer vertical edge 57 of the side is spaced from the side 12*a* of the vending machine 10. In another embodiment, as shown in FIGS. 1, 2, and 4, the side of the panel 24 can include a stack of metal or metal alloy strips attached (e.g., welded, riveted, bolted, or the like) together in a step-like manner such that an edge of the outermost strip also provides the spaced outer vertical edge 57 of the panel 24.

As known by those having ordinary skill in the art, some original vending machines are equipped with panels that cover the side area of the vending machine (such as 12*a* of machine 10). These panels can be considered as a partial lamination of the column. These panels are generally flat in nature and give little protection for vandalism. Instead, they act more or less to add safety to the vending machine as it is closed. In particular, the partial panel extends beyond the side door surfaces and overlaps the side of the cabinet before locking of the door can occur either through a T-handle or an electronic lock. As will be recognized by those having ordinary skill in the art, the application of the apparatus of this invention in an after market case, would cause this partial panel to be removed and discarded. Nevertheless, the safety overlap continues in this design as it mimics this area.

The L-shaped corner panel 24 is brought to practice as a device that covers the entirety of the exposed area of vending machine vertical column 16. This adds substantial strength to the vending machine door for better closing alignment and to the integrity of the entire vending machine when the door is closed. The welding and the shape of the panel 24 cause it to be one solid part. As known by those having ordinary skill in the art, the vertical column 16 of the original vending machine is composed of many parts fastened with screws and the like. These screws cause the door to become very flexible. This flex causes easy access to critical areas within the vending machine.

As previously explained above, one alternative embodiment of the present invention is a collinear panel or strip 43 (FIGS. 1, 2, 3, 4, and 14) as part of the vending machine frame or body. This collinear panel 43 has a shape as viewed from its end as a letter "J" to form a channel 44. This collinear panel 43 is fitted to receive the trail edge 57 of the side 56 of the generally L-shaped panel 24 as it was defined as a safety device previously. The receiving of the edge 57 within channel 44 causes the edge to have no easy access point for prying on the side. Alternately, if a pry bar is forced in, the geometry will cause the bar to slip off. This panel 43 is secured to the vending machine 10 with commercial fasteners such as bolts 45, screws, or rivets. These fasteners can either pass through the cabinet or surface mount to the vending machine cabinet. In one embodiment, the fasteners are inserted through holes drilled through the vending machine cabinet.

Another embodiment also considers removal of the T-Handle opening provided by the panel 24. For instance, if an electronic lock (e.g., U.S. Pat. No. 6,575,504 to Roatis et. al. incorporated herein by reference) is used to secure the outer door, then there is no requirement for an opening to expose the T-Handle. Therefore the panel 24 can be considered without the T-Handle opening.

Another embodiment of the present invention provides for the addition of bolts strategically placed about the front surface of the panel 24 as to continue to reinforce the anti pry attributes of the panel as well as the structural reinforcement.

It should also be appreciated in view of this disclosure that when integrating fortification panels to multiple areas commonly attached, more favorable and common attachment points to the column can be utilized to secure fortification for all protected areas.

Turning to FIGS. 1, 2 and 9-12, in one embodiment a plate 42 can be attached to the front 54 of the panel 24. The plate 42 can be attached by common fasteners or by welding. Preferably, the plate 42 is secured over an opening in the panel 42 that receives a portion of the vending machine customer interface 25 comprising, for example: the coin entry 26, the display 28, and the eject actuator 30. As will be appreciated by those having ordinary skill in the art, some vending machines have a rectangular customer interface 25 that projects from the vertical column 16. Thus, the use of a plate 42 over an opening in the panel 24 that receives the projecting customer interface 25 allows for the panel 24 to substantially abut against the vending machine vertical column 16 in this area.

After the invention is mounted on the vending machine, its operation is static in nature. However, when the vending machine is being closed it should be noted that, in an embodiment, there is an effective overlap of surfaces (see FIGS. 3, 4, and 14). This overlapping occurs so as not to give a would-be attacker point of leverage for his attacking device, such as a screwdriver or crowbar. As a result of the attachment of the panel 24 over the vending machine vertical column 16, the product/vend selection actuators or buttons 34 are recessed further from a customer than if the panel 24 was not attached to the vending machine cabinet 12.

As indicated previously, the panel 24 is attached to the vending machine 10 by using fasteners 39 (FIGS. 1-3) such as bolts and nuts, screws, rivets, or the like. The panel 24 can be installed to the vending machine 10 by: opening the vending machine outer door 14*a*; generally aligning openings in the panel 24 with the product select actuators 34 or other customer interface devices; drilling holes within the vertical column and/or cabinet; attaching the panel 24 to the machine with the fasteners 39; and, closing the outer door 14*a*. Alternatively, existing fastener holes in the vending machine cabinet outer door and can be used for attaching the panel.

Figure 17:
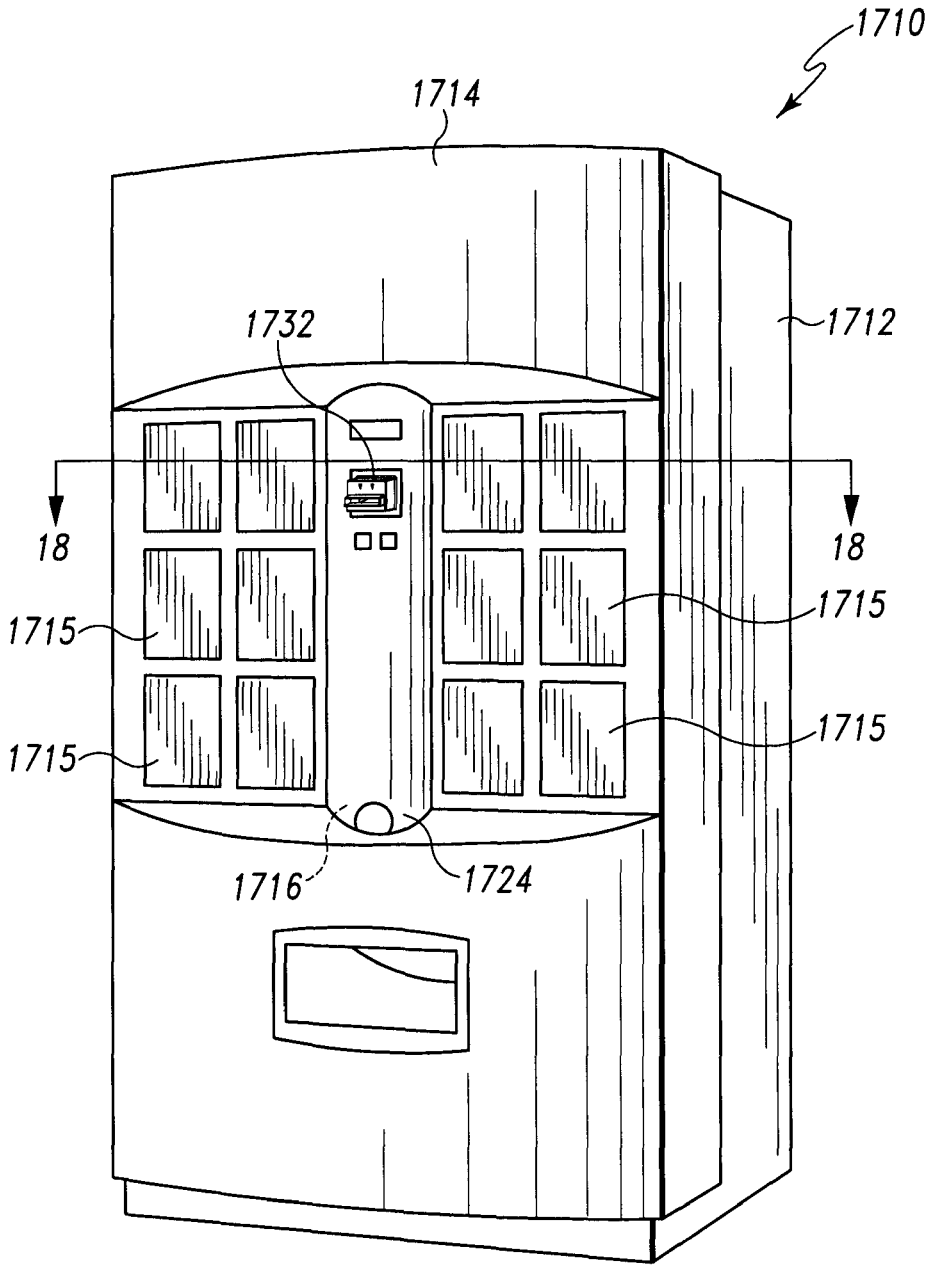
FIG. 17 is a front elevation view of another embodiment of a vending machine having a device or panel attached thereto in accordance with the present invention.
Figure 18:
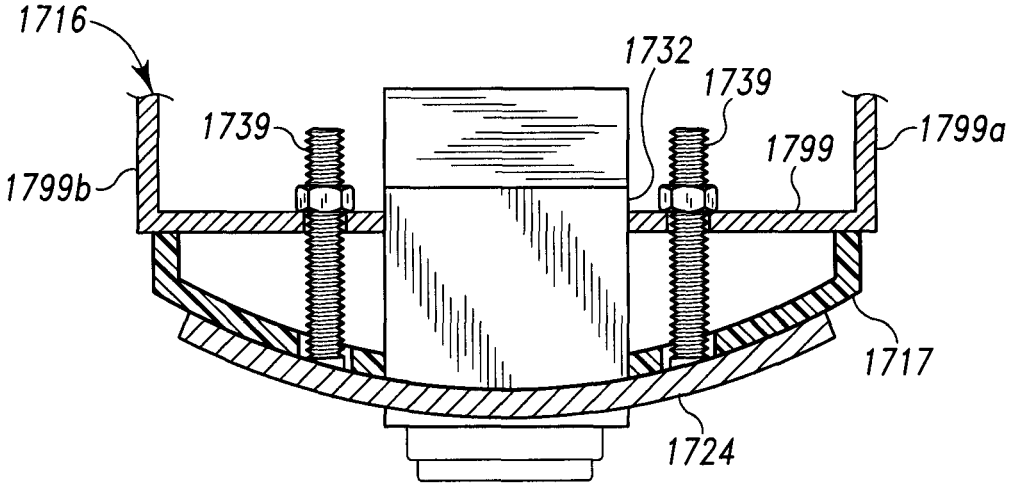
FIG. 18 is a partial cross-sectional top view taken along line 18-18 of FIG. 17.

Turning to FIGS. 17 and 18, another embodiment of the invention is configured on a center-column vending machine. The vending machine 1710 includes a cabinet 1712 having a door 1714 with a center column 1716. The center column is mounted within the door and is used to house the money, logic systems; and consumer access devices except for vend select panels or actuators 1715. As noted previously, such vending machines are provided by The Vendo Company, Fresno, Calif., under the model designation Pepsi High Visibility Vendor ("HVV").

As disclosed in FIG. 18, the vertical column has a front wall 1799 and two side walls 1799*a*, 1799*b*. A panel 1717 is mounted to the face of wall 1799. This panel is used when a security panel such as panel 1724 is not present on the machine as an OEM component. The panel is primarily for aesthetic purposes. Thus, FIGS. 17 and 18 disclose an after-market device according to the invention where the panel 1724 is mounted over the aesthetic panel 1717 and is and formed to match the arcuate shape of the aesthetic panel 1717 for ease of installation and to be faithful to the aesthetic design. Among other things, panel installation is made easier because, as can be seen in FIG. 18, a paper currency validator 1732 in the column 1716 extends well beyond column wall 1799 so as to be accessed through the arcuate aesthetic panel 1717. Thus, making the panel 1724 arcuate avoids having to remount the paper currency validator. It should be appreciated that a panel such as panel 1724 could, from an OEM standpoint, be attached to the vertical column 1716 in place of the aesthetic panel 1717 and any aesthetic shape be provided primary by the panel 1724. The panel 1724 preferably, but not necessarily has a length sufficient to cover the entire height of the center column 1716.

The vertical column 1716 has openings for consumer interface devices such as the paper currency validator 1732 and the panel 1724 has corresponding openings for consumer access to these devices. Other consumer interface devices could include a coin entry, an eject actuator, a card reader, and a coin return cavity.

According to another aspect of the invention, preferably, the panel 1724, or a portion attached thereto, covers more of the paper currency validator than what is covered by the center column 1716. In other words, it is advantageous for the opening in panel 1724 to be smaller than the perimeter of the paper currency validator exposed by the opening in the vertical column 1716.

As shown in FIG. 18, extending from the panel 1724 are threaded studs 1739 used in attaching the panel to the vending machine door. In particular, the studs 1739 are attached to the panel 1724 by welding or the like. The studs extend through openings made in the aesthetic panel 1717 and in the wall 1799 of the column 1716. Nuts are threaded onto the studs 1739 to secure the panel to the column 1716.

As will be appreciated by those having ordinary skill in the art in view of this disclosure, that additional security measures can be added to the vending machine of FIGS. 17 and 18 such as, but not limited to, the locking device placed and configured as disclosed in FIGS. 15 and 16. Also, although not integrated with panel 1716, added security for machine 1710 could also be provided with the apparatus disclosed in FIGS. 5-8. It should also be appreciated that a shield such as shield 78 (see for example FIGS. 2, 3 and 9-13) could be incorporated into the panel 1724 to provide added protection for the paper currency validator 1732 or a card reader for example. Similarly, where appropriate, a plate, such as plate 42 (FIGS. 9-12) could be provided integrally with plate 1724.

It should be emphasized that the above-described embodiments of the present invention, particularly, any "preferred" embodiments, are possible examples of implementations merely set forth for a clear understanding of the principles of the invention. Many variations and modification may be made to the above-described embodiment(s) of the invention without substantially departing from the spirit and principles of the invention. All such modifications are intended to be included herein within the scope of this disclosure and the present invention, and protected by the following claims.

What is claimed is:

1. A vending machine having a cabinet for containing product to be dispensed, and a door for closing the cabinet, the door having a vertical column having two sides and a front face, the front face having openings permitting customer interface devices to be accessed by a customer, the vending machine further comprising:

a continuous integral panel including a metal or metal alloy, the panel secured to the vertical column and extending across at least a majority of a width of the front face of the vertical column and extending along at least a majority of a horizontal width of a side of the vertical column.

2. The vending machine of claim 1 wherein the panel having openings which align with at least two customer interface openings in the vertical column, so as to permit at least one customer interface device to be accessed by a customer through the panel, wherein the customer interface devices are selected from the group consisting essentially of: a coin entry and eject actuator; a paper currency validator; card reader; product/vend selection actuators; and a coin return cavity.

3. The vending machine of claim 1 wherein the vertical column has an access opening for a T-handle, and the panel having an opening for the T-handle.

4. The vending machine of claim 3 wherein the continuous panel having a top end and a bottom end, and further comprising a cross member at the top end spanning between a top edge of the front face and a top edge of the portion of the panel extending along a side of the vertical column.

5. The vending machine of claim 4 wherein the cross member incorporates a first member of a locking device, and the cabinet has attached thereto a second, mating member of said locking device, whereby the door can be secured to the cabinet through cooperation of the first and second members.

6. The vending machine of claim 4 wherein the cross member presents an open edge which will deflect forces applied to a prying tool when such a tool is inserted between the open edge and edges of the door or cabinet when closed together.

7. The vending machine of claim 6 wherein the open edge forms one leg of a triangle.

8. The vending machine of claim 1 wherein the continuous panel extends beyond a rear edge of the side of the column and overlaps a portion of a side of the cabinet.

9. The vending machine of claim 8 including a vertical channel formed on a side of the cabinet, and wherein the panel extends into the channel.

10. A vending machine having a cabinet for containing product to be dispensed, and a door for closing the cabinet, the door having a vertical column having two sides and a front face, the vending machine further comprising:

a continuous integral panel including a metal or metal alloy, the panel having a portion secured to one or more of the front face or a side face of the vertical column, or to a side face of the cabinet, the panel also having a top extending generally horizontally over the junction of edges on the top of an area where the door and cabinet form a seal when closed.

11. The vending machine of claim 10 wherein the panel portion is part of a continuous integral panel secured to the vertical column and extending across at least a majority of a width of the front face of the vertical column and extending along at least a majority of a horizontal width of a side of the vertical column.

12. The vending machine of claim 10 wherein top of the panel portion presents at least one open edge which will deflect forces applied to a prying tool when such a tool is inserted between the open edge and edges of the door or cabinet when closed together.

13. The vending machine of claim 12 wherein the open edge forms one leg of a triangle.

14. The vending machine of claim 10 wherein the top of the panel portion incorporates a first member of a locking device, and the cabinet has attached thereto a second, mating member of said locking device, whereby the door can be further secured to the housing through cooperation of the first and second members.

15. A vending machine having a cabinet for containing product to be dispensed, and a door for closing the cabinet, the door having a vertical column having two sides and a front face, the front face having openings permitting customer interface devices to be accessed by a customer the machine further comprising:

a continuous integral panel including a metal or metal alloy, the panel secured to the door over at least a portion of the front face of the vertical column, the panel having openings which align with at least two customer interface openings in the vertical column, so as to permit at least two customer interface devices to be accessed by a customer through the panel; wherein the customer interface devices are selected from the group consisting essentially of: a coin entry with display and eject actuator; a paper currency validator; card reader; product/vend selection actuators; and a coin return cavity.

16. The vending machine of claim 15 wherein the vertical column has an access opening for a T-handle, and the panel having an opening for the T-handle.

17. The vending machine of claim 15 wherein the continuous panel extends beyond the side of the column rear edge and overlaps a portion of a side of the cabinet.

18. The vending machine of claim 17 including a vertical channel formed on a side of the cabinet, and wherein the panel extends into the channel.

19. The vending machine of claim 15 wherein the continuous panel extends over at least a portion of the side of the vertical column.

20. The vending machine of claim 17 wherein the panel having a front-facing portion and a side-facing portion and having a top end and a bottom end, and further comprising a cross member at the top end spanning between the front-facing portion and the side facing portion.

21. The vending machine of claim 20 wherein the cross member is a plate welded to the panel.

22. The vending machine of claim 20 wherein cross member presents at least one open edge which will deflect forces applied to a prying tool when such a tool is inserted between the open edge and edges of the door or cabinet when closed together.

23. The vending machine of claim 20 wherein the cross member incorporates a first member of a locking device, and the cabinet has attached thereto a second, mating member of said locking device, whereby the door can be further secured to the housing through cooperation of the first and second members.

24. The vending machine of claim 23 wherein the first member is a through hole in the cross member and the second member is a strap having a through hole whereby the two through holes may be aligned and secured by the locking device.

25. A vending machine having a cabinet for containing product to be dispensed, and a door for closing the cabinet, the door having a vertical column having two sides and a front face, the front face having openings permitting customer interface devices to be accessed by a customer, the vending machine further comprising:

a paper currency validator mounted inside the vertical column, the paper currency validator having an opening or slot for accepting bills, the bill slot being aligned with an opening in vertical column for passage of bills into the paper currency validator;

a shield mounted to the vending machine door, the shield including a front wall which is spaced sufficiently from the vertical column such that impact on the shield front wall is not transferred to the paper currency validator or the vertical column direct contact with the front wall of the shield;

at least one support for supporting the front wall of the shield and spacing it from the paper currency validator slot; and, an opening in the front wall of the shield for permitting passage of a bill there through and into the paper currency validator.

26. The vending machine of claim 25 wherein the front wall of the shield and the support defines a five-sided enclosure.

27. The vending machine of claim 25 wherein the shield is an integral part of a continuous integral panel secured to the vertical column and extending across at least a majority of a width of the front face of the vertical column and extending along at least a majority of a horizontal width of a side of the vertical column.

28. The vending machine of claim 27 wherein the continuous panel having openings which align with at least two customer interface openings in the vertical column, so as to permit at least one other customer interface device to be accessed by a customer through the panel; wherein the customer interface devices are selected from the group consisting essentially of: a coin entry and eject actuator; card reader; product/vend selection actuators; and a coin return cavity.

29. The vending machine of claim 25 wherein the vertical column has an access opening for a T-handle, and the panel having an opening for the T-handle.

30. The vending machine of claim 25 wherein the continuous panel extends beyond the side of the column rear edge and overlaps a portion of a side of the cabinet.

31. The vending machine of claim 30 including a vertical channel formed on a side of the cabinet, and wherein the panel extends into the channel.

32. The vending machine of claim 25 wherein the opening in front wall of the shield is adjustable in size and vertical location.

33. The vending machine of claim 25 wherein the shield front face and support define a cavity surrounding the paper currency validator and the cavity is sized to accommodate more than one vertical or horizontal positioning of the paper currency validator in the vertical column.

34. A method of modifying a vending machine having a cabinet with an outer surface and a vertical column having a front, a side, and product selection actuators, the method comprising the steps of:

opening the cabinet;

drilling at least one hole within the cabinet;

aligning openings in a generally L-shaped panel with the product selection actuators to provide access to the product section actuators when the panel is attached to the cabinet;

attaching the panel to the outer surface of the cabinet over at least a portion of the front and side of the vertical column; and, closing the cabinet.

35. The method of claim 34, further comprising the step of fitting the panel over a paper currency validator.

36. The method of claim 34, further comprising the step of aligning an opening in the panel with a paper currency validator.

37. The method of claim 34, further comprising the step of removing a lock from the cabinet.

38. The method of claim 34, further comprising the step of attaching a lock to the panel.

39. The method of claim 34, further comprising the step of attaching a strip to the outer surface of the cabinet, the strip providing a channel for receiving a portion of the panel when the cabinet is closed.

40. A method of modifying a vending machine having a cabinet with an outer surface and a center column having a coin insertion opening, the method comprising the steps of:

opening the cabinet;

aligning openings in a panel with the coin insertion opening to provide access to the coin insertion opening when the panel is attached to the cabinet;

attaching the panel to the outer surface of the cabinet over at least a portion of the center column; and, closing the cabinet.

41. The method of claim 40, further comprising the step of fitting the panel over a paper currency validator.

42. The method of claim 41, further comprising the step of aligning an opening in the panel with the paper currency validator.

43. A method of modifying a vending machine having a cabinet with an outer surface and a center column having a paper currency validator, the method comprising the steps of:

opening the cabinet;

aligning openings in a panel with at least a portion of the paper currency validator to provide access to an paper currently insertion slot in the paper currency validator when the panel is attached to the cabinet;

attaching the panel to the outer surface of the cabinet over at least a portion of the center column; and, closing the cabinet.

44. The method of claim 43, further comprising the step of fitting the panel about a coin insertion opening in the vending machine.

45. The method of claim 44, further comprising the step of aligning an opening in the panel with the coin insertion opening.

46. An apparatus for attachment to a center column of a vending machine having a coin entry, the apparatus comprising:

a rigid panel having an inner surface and at least one opening;

at least one stud attached to the panel and extending from the inner surface; and, wherein the coin entry is accessible via the opening when the panel is attached to the vending machine and covers at least a portion of the center column.

47. The apparatus of claim 46, wherein the panel surrounds an opening to a paper currency validator.

48. The apparatus of claim 46, wherein at least a portion of the panel is outwardly curved.

49. The apparatus of claim 46, wherein a majority of the panel is outwardly curved.

50. An apparatus for attachment to a center column of a vending machine having a paper currency opening, the apparatus comprising:

a rigid panel having an inner surface and at least one opening;

at least one stud attached to the panel and extending from the inner surface; and, wherein the paper currency opening is accessible via the opening in the panel when the panel is attached to the vending machine and covers at least a portion of the center column.

51. The apparatus of claim 50, wherein the paper currency opening is aligned with a slot in a paper currency validator.

52. The apparatus of claim 50, wherein at least a portion of the panel is outwardly curved.

53. The apparatus of claim 50, wherein a majority of the panel is outwardly curved.

54. An apparatus comprising:

a vending machine including a door and a cabinet;

a first rigid strip having a distal end and a proximal end, the distal end having an opening extending therethrough and the proximal end attached to the cabinet, the distal end being in spaced parallel relationship with the proximal end;

a second rigid strap having a distal end and a proximal end, the distal end having an opening extending therethrough and the proximal end attached to the door, the opening in the first rigid strip being in coaxial alignment with the opening in the second rigid strap when the door is closed.

55. The apparatus of claim 54, further comprising a lock having a shackle extending through the openings in the first and second rigid strips.

56. The apparatus of claim 55, wherein the lock is tethered to the first rigid strip or the second rigid strip.

* * * * *